US010347420B2

(12) United States Patent
Kanno et al.

(10) Patent No.: US 10,347,420 B2
(45) Date of Patent: Jul. 9, 2019

(54) WINDING DEVICE AND WINDING METHOD

(71) Applicant: NITTOKU ENGINEERING CO., LTD., Saitama-shi, Saitama (JP)

(72) Inventors: Takashi Kanno, Fukushima (JP); Kaoru Noji, Fukushima (JP)

(73) Assignee: NITTOKU ENGINEERING CO., LTD., Saitama-Shi, Saitama (JP)

( * ) Notice: Subject to any disclaimer, the term of this patent is extended or adjusted under 35 U.S.C. 154(b) by 346 days.

(21) Appl. No.: 15/117,748

(22) PCT Filed: Jan. 5, 2015

(86) PCT No.: PCT/JP2015/050067

§ 371 (c)(1),
(2) Date: Aug. 10, 2016

(87) PCT Pub. No.: WO2015/133156

PCT Pub. Date: Sep. 11, 2015

(65) Prior Publication Data

US 2016/0351329 A1 Dec. 1, 2016

(30) Foreign Application Priority Data

Mar. 4, 2014 (JP) ..... 2014-041218

(51) Int. Cl.

| | |
|---|---|
| ***H01F 7/06*** | (2006.01) |
| ***H02K 15/00*** | (2006.01) |
| ***H01F 41/096*** | (2016.01) |
| ***H01F 41/07*** | (2016.01) |

(52) U.S. Cl.

CPC ..... *H01F 41/096* (2016.01); *H01F 41/07* (2016.01); *Y10T 29/49071* (2015.01); *Y10T 29/53143* (2015.01)

(58) Field of Classification Search

CPC ..... Y10T 29/49009; Y10T 29/49012; Y10T 29/49071; B29C 41/085; B29C 64/209; B29C 70/32; H02K 15/0435; H02K 3/18

USPC ..... 29/605, 596, 598, 606, 732

See application file for complete search history.

(56) References Cited

U.S. PATENT DOCUMENTS 4,388,752 A * 6/1983 Vinciguerra ..... B21D 39/04 138/147
6,639,170 B2 * 10/2003 Becherucci ..... H02K 15/09 219/148

FOREIGN PATENT DOCUMENTS

JP H11-97274 A 4/1999

* cited by examiner

*Primary Examiner* — Thiem D Phan
(74) *Attorney, Agent, or Firm* — Rabin & Berdo, P.C.

(57) ABSTRACT

A winding device includes a nozzle holding mechanism for holding a plurality of nozzles in substantially parallel with each other, a nozzle rotation driving mechanism for rotating the nozzle holding mechanism about a rotation axis being substantially parallel with the plurality of nozzles, a spool supporting mechanism for supporting a plurality of spools in substantially parallel with each other, a spool rotation driving mechanism for rotating the spool supporting mechanism about a rotation axis being substantially parallel with the plurality of spools and being coaxially with or substantially parallel with the rotation axis of the nozzle holding mechanism, and a control unit for controlling the spool rotation driving mechanism in such a manner as to rotate the spool supporting mechanism in synchronism with rotation of the nozzle holding mechanism.

6 Claims, 15 Drawing Sheets

WINDING DEVICE AND WINDING METHOD

TECHNICAL FIELD

The present invention relates to a winding device and a winding method for twisting and winding a plurality of wires around a core.

BACKGROUND ART

Conventionally, small electronic devices and the like use transformers and chip coils that are made by winding twisted wires around a core. For example, JP 11-097274A discloses a winding method comprising causing wires to respectively pass through a plurality of nozzles provided in parallel with each other, rotating the plurality of nozzles about a rotation axis which is parallel with the nozzles so as to twist the wires, and winding the twisted wires around a core.

SUMMARY OF INVENTION

However, when the plurality of wires, respectively passing through the plurality of nozzles, are provided from separate spools around which wires are wound, the wires have to be respectively unwound from the separate spools and inserted through the plurality of nozzles separately.

When the nozzles are rotated to twist the wires delivered from the nozzles, and the twisted wires are wound around the core, the wires between the plurality of spools and nozzles are also twisted in a similar manner. Therefore, a twisted amount of the wires that are wound around the core is limited to a number of twists possible between the spools and the nozzles. Accordingly, it is not possible to twist the wires for a large number of times.

In addition, after the wires delivered from the nozzles and twisted by rotating the nozzles are wound around the core, it is necessary to rotate the plurality of nozzles in the reverse direction to eliminate the twist of the wires between the spools and the nozzles before making the next winding. This makes it difficult to conduct winding process continuously without interruption.

It is therefore an object of the present invention to realize a continuous winding process without a limit of the number of times of rotating the nozzles for twisting the wires, in a winding device in which a plurality of wires configured to pass through a plurality of nozzles separately are wound around separate spools for storage.

In order to achieve the above object, the present invention provides a winding device having a plurality of nozzles for separately delivering a plurality of wires unwound separately from a plurality of spools, and twisting and winding the plurality of wires, delivered respectively from the plurality of nozzles, around an outer periphery of a core. The winding device comprises a nozzle holding mechanism for holding the plurality of nozzles in a substantially parallel manner, a nozzle rotation driving mechanism for rotating the nozzle holding mechanism about a rotation axis being substantially parallel with the plurality of nozzles, a spool supporting mechanism for supporting the plurality of spools in a substantially parallel manner, a spool rotation driving mechanism for rotating the spool supporting mechanism about a rotation axis being substantially parallel with the plurality of spools and being coaxially with or substantially parallel with the rotation axis of the nozzle holding mechanism, and a control unit for controlling the spool rotation driving mechanism in such a manner as to rotate the spool supporting mechanism in synchronism with rotation of the nozzle holding mechanism.

The details as well as other features and advantages of the present invention are set forth in the remainder of the specification and are shown in the accompanying drawings.

DESCRIPTION OF EMBODIMENTS

A winding device 9 according to an embodiment of the present invention will be explained with reference to the drawings.

Figure 1:
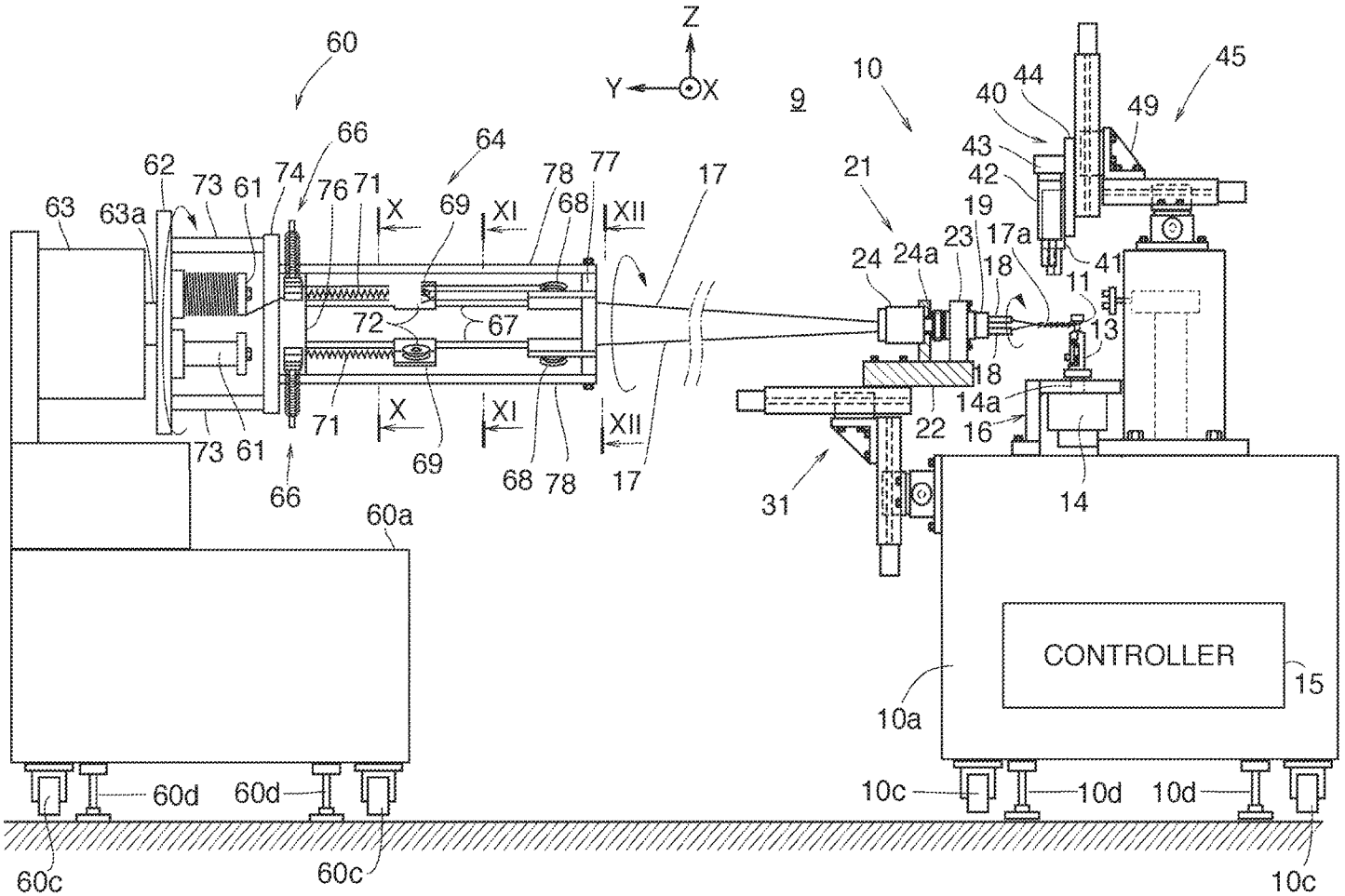
FIG. 1 is a front view of a winding device according to an embodiment of the present invention.

Referring to FIG. 1 of the drawings, the winding device 9 includes a wire delivering mechanism 60 that delivers a plurality of wires 17, and a wire winding mechanism 10 that causes the plurality of wires 17, delivered from the wire delivering mechanism 60, to wind around a core 11. Hereinafter, three axes of X, Y, and Z, orthogonal to one another, are set, and explanations are given supposing that, in FIG. 1, the horizontal fore-and-aft direction is the X-axis, the horizontal lateral direction is the Y-axis, and the vertical direction is the Z-axis.

Referring to FIGS. 1-9, the wire winding mechanism 10 of the winding device 9 will be explained.

Figure 2A:
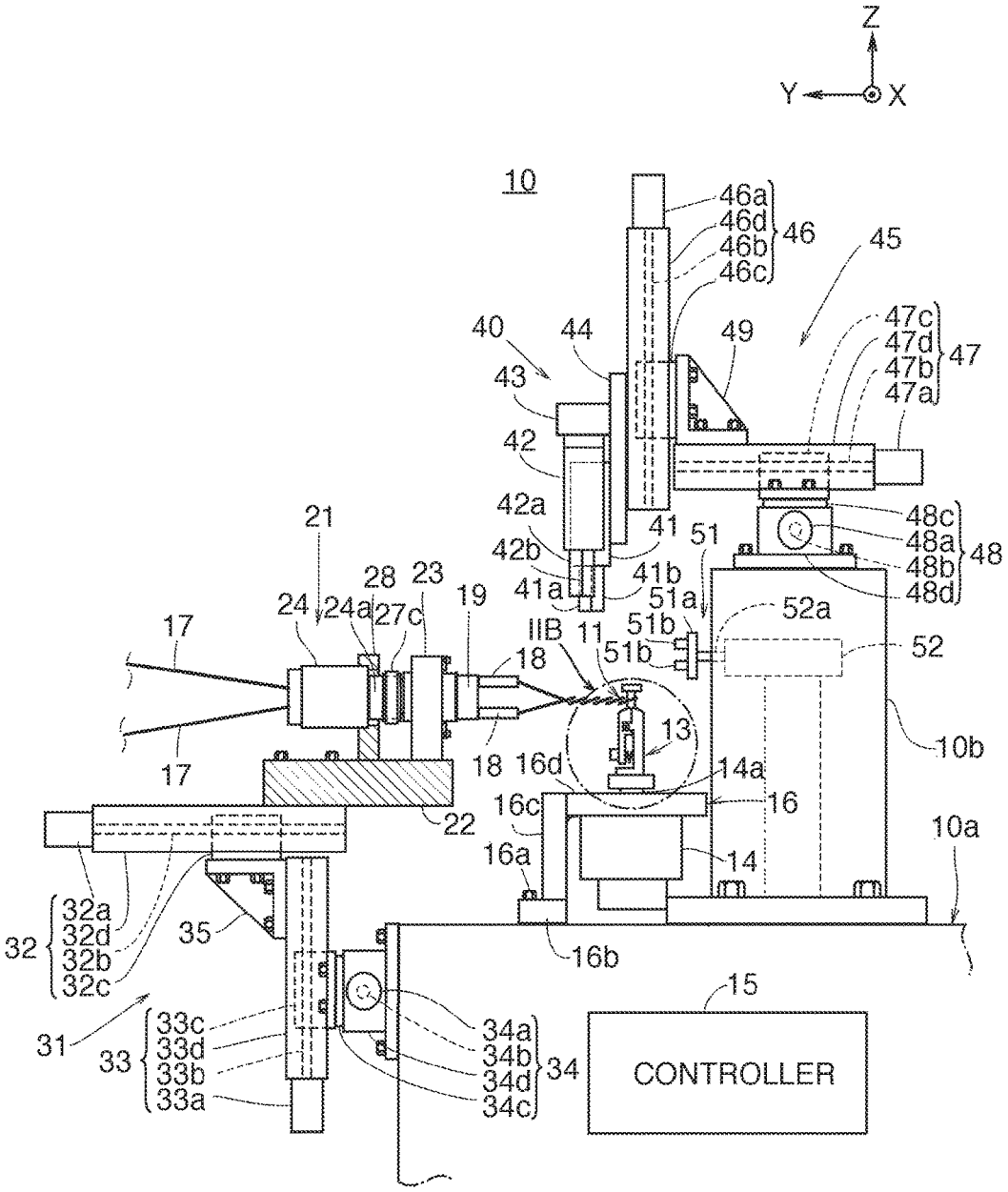
FIG. 2A is a front view of a wire winding mechanism.
Figure 2B:
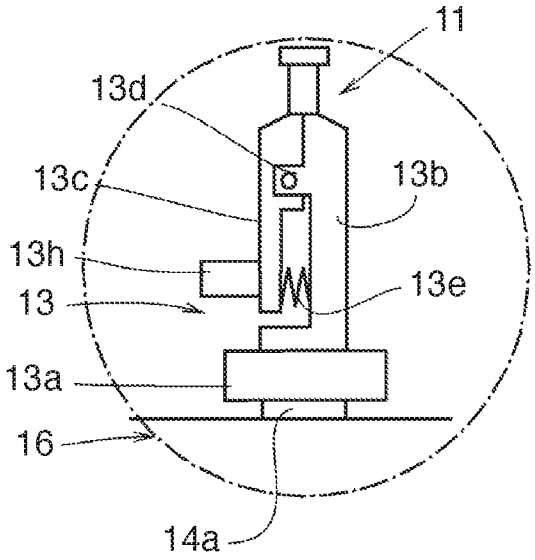
FIG. 2B is an enlarged view of an IIB part in FIG. 2A.
Figure 3:
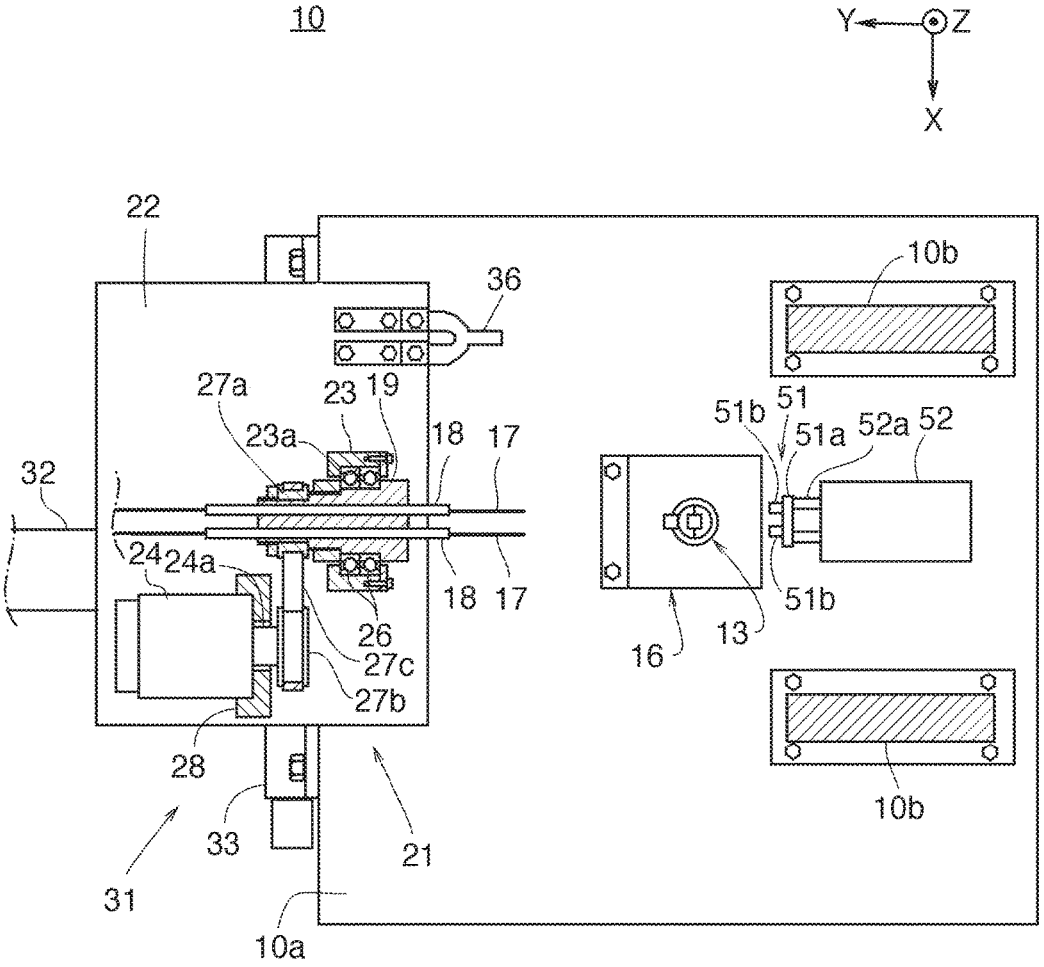
FIG. 3 is a plan view of the wire winding mechanism.
Figure 4:
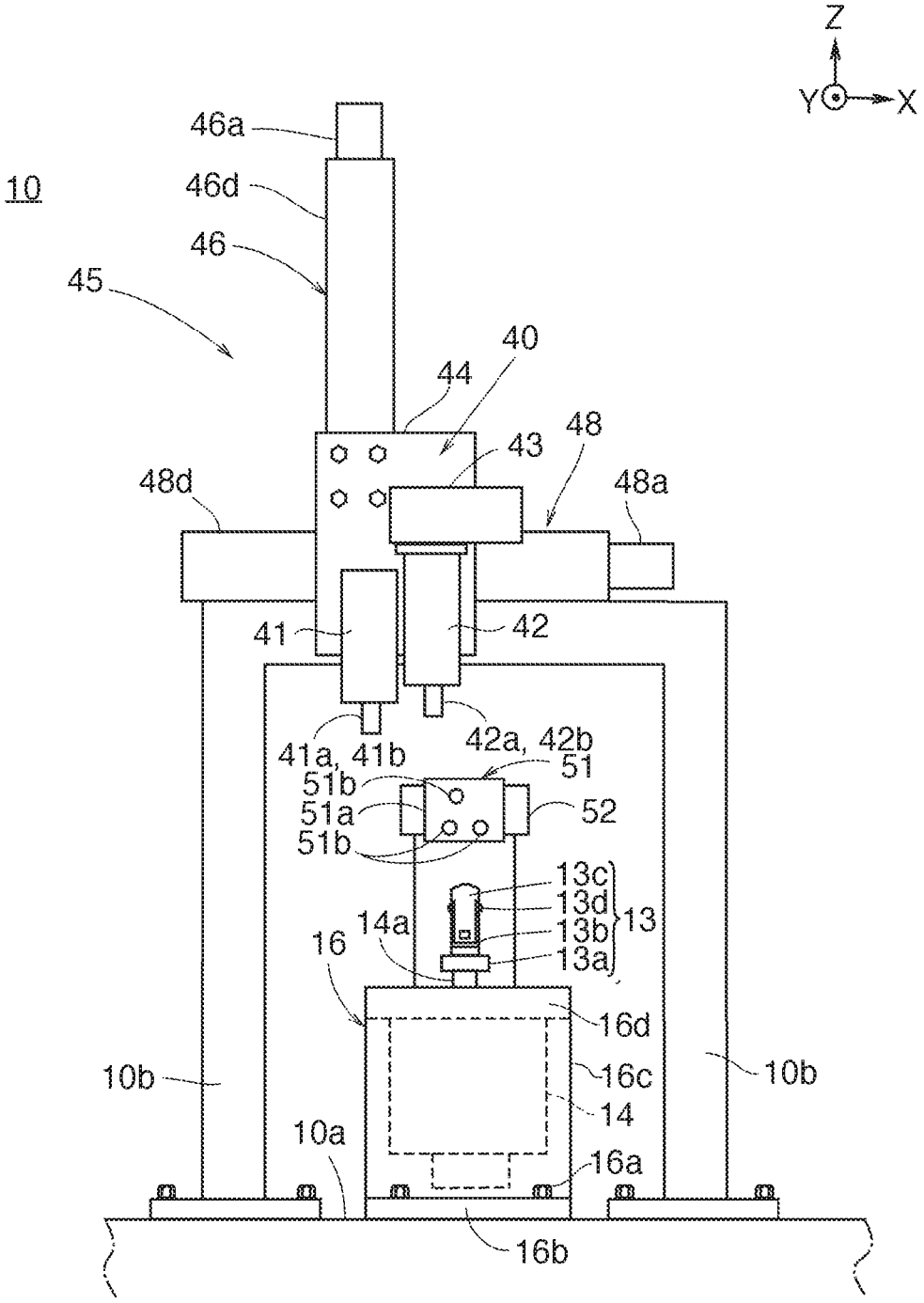
FIG. 4 is a left side view of the wire winding mechanism.

As illustrated in FIGS. 2-4, the wire winding mechanism 10 is provided with a chuck 13 to which the core 11, around which the wires 17 are wound, is mounted.

Figure 5:
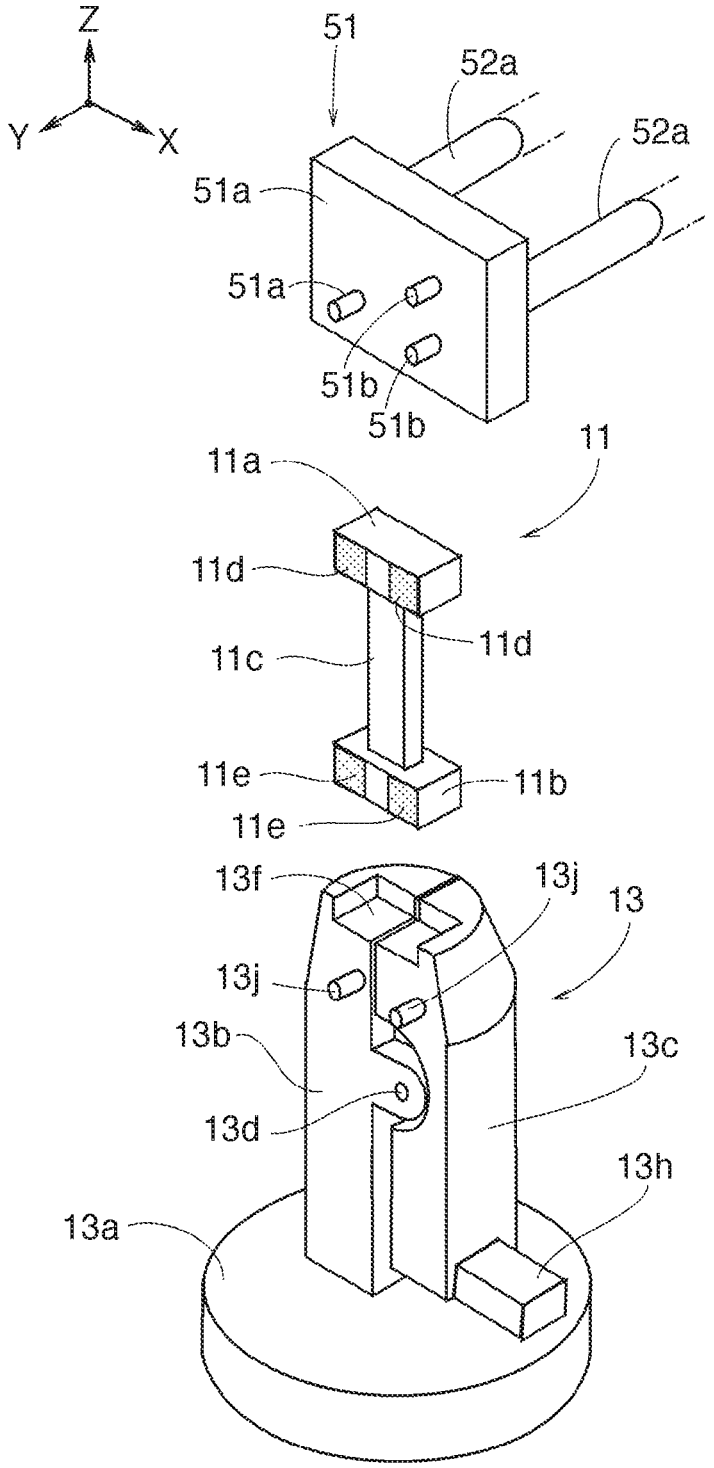
FIG. 5 is a perspective view illustrating a core and a chuck supporting the core.

As illustrated in FIG. 5, the core 11 is formed of an insulating material including a dielectric substance, magnetic substance, insulating ceramic, plastic or the like. The core 11 is in the form of a bobbin having a winding drum portion 11*c* and flange portions 11*a* and 11*b* formed on both ends of the winding drum portion 11*c*.

The winding drum portion 11*c* has a rectangular cross sectional shape. On both ends of the winding drum portion 11*c*, the flange portion 11*a* and the flange portion 11*b* are formed. Each of the flange portion 11*a* and the flange portion 11*b* is formed to have a rectangular shape, so as to be gripped by the chuck 13. Further, electrodes 11*d* and electrodes 11*e* as terminals on which the wires 17 are fixed, as will be described later, are formed at two positions on each of the flange portion 11*a* and the flange portion 11*b*.

As illustrated in FIG. 2A, the chuck 13 for gripping the core 11 is coaxially attached to the upper end portion of a rotating shaft 14*a* that extends in the vertical direction (Z-axis direction) from a chuck motor 14 provided on a base 10*a*. In other words, the chuck 13 is provided on the base 10*a* via the chuck motor 14. An attaching member 16 for fixing the chuck motor 14 on the base 10*a* includes a base plate 16*b* that is fixed on the base 10*a* by bolts 16*a*, a wall plate 16*c* that is welded to the base plate 16*b* and extends in the Z-axis direction, and an upper plate 16*d* that is horizontal and is welded to the upper portion of the wall plate 16*c*. The chuck motor 14 is attached to the upper plate 16*d* in such a manner that the rotating shaft 14*a* is in the Z-axis direction.

According to this embodiment, the chuck 13 is used for mounting the core 11, but other methods, such as a collet method, a jig centering method or the like, may be employed depending on the shape of the core 11.

As illustrated in FIG. 2B and FIG. 5, the chuck 13 includes a large diameter portion 13*a* that has a disc shape and is coaxially connected to the rotating shaft 14*a*, a main gripping portion 13*b* that is provided continuously and coaxially with the large diameter portion 13*a*, and a swinging member 13*c* that is pivotally supported by the main gripping portion 13*b*. The swinging member 13*c*, overlapping the main gripping portion 13*b*, is pivotally supported by the main gripping portion 13*b* by a pin 13*d*. In the overlapped swinging member 13*c* and the main gripping portion 13*b* on a tip end side, as illustrated in FIG. 5, there is provided a recessed portion 13*f* that surrounds and supports the flange portion 11*b* at a lower end of the core 11.

Figure 6:
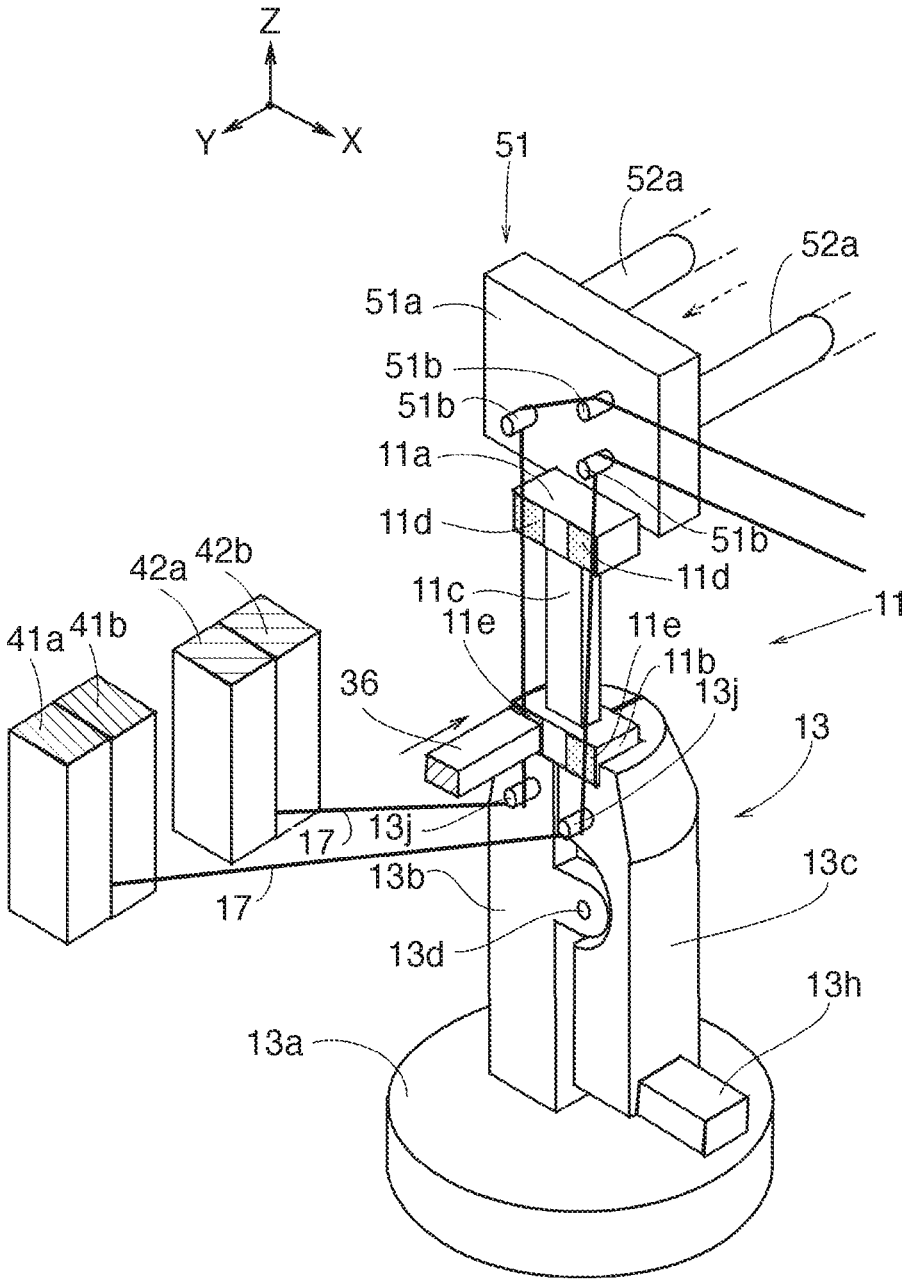
FIG. 6 is a perspective view illustrating a state where the core is supported by the chuck and wires are fixed to terminals on one side.

As illustrated in FIG. 6, the flange portion 11*b*, received in the recessed portion tip ends of the swinging member 13*c* and the main gripping portion 13*b* grip 13*f*, and thus the flange portion 11*b* of the core 11 can be gripped by the chuck 13. A part of the recessed portion 13*f* is cut out so as to expose the side surface of the flange portion 11*b*, on which the electrodes 11*e* are provided. A plurality of lower locking pins 13*j* are provided on a side surface of the main gripping portion 13*b* and the swinging member 13*c*, on which the electrodes 11*e* are located.

As illustrated in FIG. 6, the lower locking pins 13*j* are provided at positions where the wires 17, looped around the lower locking pins 13*j* and directed upward, can be overlapped on the electrodes 11*e* of the core 11.

Further, as illustrated in FIG. 2B, a coil spring 13*e* is interposed between the swinging member 13*c* and the main gripping portion 13*b* on a side closer to the large diameter portion 13*a* than to the pin 13*d*, the coil spring 13*e* biasing the swinging member 13*c* and the main gripping portion 13*b* so as to increase space there-between. The bias of the coil spring 13*e* is made so that the flange portion 11*a* or 11*b* at the end of the core 11 is gripped by the tip end of the swinging member 13*c* and the tip end of the main gripping portion 13*b*.

On the swinging member 13*c* on the side closer to the large diameter portion 13*a* than to the pin 13*d*, a movable projection 13*h* for reducing the space between the swinging member 13*c* and the main gripping portion 13*b* against a biasing force of the coil spring 13*e* is provided, on the side closer to the large diameter portion 13*a* than to the pin 13*d*. The movable projection 13*h* can be operated to increase the space between the tip end of the swinging member 13*c* and the tip end of the main gripping portion 13*b*.

A control signal of a controller 15 illustrated in FIG. 1 and FIG. 2A, as a control unit for controlling the winding device 9, is inputted to the chuck motor 14, on the tip end of which the chuck 13 is provided on the rotating shaft 14*a*.

The controller 15 is embedded in the base 10*a*. With the chuck motor 14, the rotating shaft 14*a* is driven to rotate according to an instruction from the controller 15. The chuck motor 14 causes the chuck 13, provided on the rotating shaft 14*a*, to rotate together with the core 11 that is supported by the chuck 13. Thereby, the chuck motor 14 causes the wires 17, delivered from the wire delivering mechanism 60, to be wound around the winding drum portion 11*c* of the rotating core 11.

The wire winding mechanism 10 further comprises a plurality of nozzles 18 that deliver the plurality of wires 17 separately, the wires 17 being inserted there through after being separately unwound from a plurality of spools 61 in the wire delivering mechanism 60, and a shaft 19 as a nozzle holding mechanism for holding the plurality of nozzles 18 in substantially parallel with each other.

According to this embodiment, each of the wires 17 is formed of an insulation coated conducting wire having a conducting wire made from copper or copper alloy, and an insulation coating formed to cover an outer peripheral surface of the conducting wire and is melted by solder, as will be described later. Further, according to this embodiment, the wire 17 has such thickness that it can be torn off by being pulled manually.

The plurality of wires 17 are wound around the separate spools 61 for storage. According to this embodiment, two wires 17 are wound around the core 11. Each of the nozzles 18 is a tubular body through which the wire 17 can pass. Two nozzles 18 are provided such that the two wires 17 are caused to separately pass through.

The two nozzles 18 are held by the shaft 19 in substantially parallel with each other. The shaft 19 is formed to have a circular cross sectional shape. The plurality of nozzles 18 penetrate the shaft 19 in parallel with the axis of the shaft 19 and are supported in positions displaced by a same distance from the axis.

The shaft 19 is attached to the base 10*a* via a nozzle rotation driving mechanism 21 that causes the shaft 19 to rotate around the central axis being substantially parallel with the plurality of nozzles 18, and a nozzle moving mechanism 31 that causes the nozzle rotation driving mechanism 21 to move together with the shaft 19 and the plurality of nozzles 18.

As illustrated in FIG. 2A and FIG. 3, the nozzle rotation driving mechanism 21 is provided with a moving plate 22 that is parallel with the upper surface of the base 10*a*, a support wall 23 erecting from the moving plate 22, and a rotary motor 24. The shaft 19, which causes the plurality of nozzles 18 to penetrate and thereby supports the nozzles 18, is supported by the support wall 23 so as to be free to rotate in a state where the central axis is directed in the Y-axis direction. Specifically, the shaft 19 penetrates a support hole 23*a* of the support wall 23 in such a manner that the central axis is parallel with the Y-axis direction, that is, in a horizontal manner, and the shaft 19 is supported by the support wall 23 to be able to rotate via bearings 26.

A first pulley 27*a*, whose central axis agrees with the central axis of the shaft 19, is attached to a base end of the shaft 19. Further, the rotary motor 24 that has a rotating shaft 24*a* in parallel with the central axis of the first pulley 27*a* is provided next to the shaft 19. The rotary motor 24 is attached to an attaching plate 28 that erects from the moving plate 22. A second pulley 27*b* is attached to the rotating shaft 24*a* of the rotary motor 24.

A belt 27*c* is looped around the first pulley 27*a* and the second pulley 27*b*. A control signal from the controller 15 is inputted to the rotary motor 24. When the rotary motor 24 is driven according to an instruction from the controller 15, the rotating shaft 24*a* rotates together with the second pulley 27*b*, and the rotation of the second pulley 27*b* is transferred to the first pulley 27*a* via the belt 27*c*. Thereby, the shaft 19, to which the first pulley 27*a* is attached, rotates together with the plurality of nozzles 18.

The nozzle moving mechanism 31 causes the nozzle rotation driving mechanism 21 to move, together with the nozzles 18, in the three axes directions. The nozzle moving mechanism 31 is formed of a combination of an X-axis direction expandable actuator 34, a Y-axis direction expandable actuator 32, and a Z-axis direction expandable actuator 33.

According to this embodiment, as illustrated in FIG. 2A, the moving plate 22, on which the nozzle rotation driving mechanism 21 is provided, is attached to a housing 32*d* of the Y-axis direction expandable actuator 32, so as to be able to move in the Y-axis direction. A follower 32*c* of the Y-axis direction expandable actuator 32 is attached to a housing 33*d* of the Z-axis direction expandable actuator 33 via an angle member 35, so as to be able to move on the moving plate 22 in the Z-axis direction, together with the Y-axis direction expandable actuator 32.

Further, a follower 33*c* of the Z-axis direction expandable actuator 33 is attached to a follower 34*c* of the X-axis direction expandable actuator 34, so as to be able to move on the moving plate 22 in the X-axis direction, together with the Y-axis direction expandable actuator 32 and the Z-axis direction expandable actuator 33. A housing 34*d* of the X-axis direction expandable actuator 34 is formed along the X-axis direction and fixed to the base 10*a*.

As illustrated in FIG. 3, the moving plate 22 is provided with the nozzle rotation driving mechanism 21 and an electrical heating iron 36 that can solder the wires 17, delivered from the nozzles 18, to the electrodes 11*d* and 11*e* of the core 11 (refer to FIG. 5). According to this embodiment, the electrodes 11*d* and 11*e* of the core 11 (refer to FIG. 5) are formed of a solder layer formed at an edge of each of the flange portions 11*a* and 11*b*.

The moving plate 22 can move in any of the three axes directions by the nozzle moving mechanism 31. The moving plate 22 causes the electrical heating iron 36 to make contact with the wires 17 that are overlapped on the electrodes 11*d* and 11*e* (refer to FIG. 6 and FIG. 9). Thus, the electrical heating iron 36 heats the wires 17 overlapped on the electrodes 11*d* and 11*e*, thereby soldering the wires 17 to the electrodes 11*d* and 11*e* formed of the solder layer.

As illustrated in FIG. 2A and FIG. 4, the winding device 9 is provided with a gripping mechanism 40 that grips end portions of the wires 17. The gripping mechanism 40 according to this embodiment is provided in the form of a plurality of clamp devices 41 and 42 that separately grip the wires 17 delivered from the plurality of nozzles 18. The clamp devices 41 and 42 are attached to a movable plate 44 while gripping pieces 41*a*, 41*b*, 42*a*, and 42*b* project toward a side of the chuck 13 (downward in FIG. 2A and FIG. 4).

One clamp device 41 is directly attached to the movable plate 44. Another clamp device 42 is attached to the movable plate 44 via an air cylinder 43. The air cylinder 43 causes the another clamp device 42 to move in the X-axis direction so as to increase or decrease the distance from the one clamp device 41.

The clamp devices 41 and 42 grip or release the wires 17 by opening/closing the gripping pieces 41*a*, 41*b*, 42*a*, and 42*b* by the supply or the discharge of compressed air. The air cylinder 43 causes the other clamp device 42 to move in the X-axis direction by the supply or the discharge of the compressed air. The supply or the discharge of the compressed air to/from the clamp devices 41 and 42 and the air cylinder 43 is made according to instructions from the controller 15.

The clamp devices 41 and 42 are attached to the base 10*a* via a clamp moving mechanism 45. As illustrated in FIG. 2A, the clamp moving mechanism 45 is formed of a combination of an X-axis direction expandable actuator 48, a Y-axis direction expandable actuator 47, and a Z-axis direction expandable actuator 46. Each of the expandable actuators 46-48 is formed to have the same structure as those in the above-described nozzle moving mechanism 31.

Specifically, according to this embodiment, the movable plate 44, to which the clamp devices 41 and 42 are provided, is attached to a housing 46*d* of the Z-axis direction expandable actuator 46, so as to be able to move in the Z-axis direction. A follower 46*c* of the Z-axis direction expandable actuator 46 is attached to a housing 47*d* of the Y-axis direction expandable actuator 47 via an L-shaped bracket 49, so as to be able to move on the movable plate 44 in the Y-axis direction, together with the Z-axis direction expandable actuator 46.

A follower 47*c* of the Y-axis direction expandable actuator 47 is attached to a follower 48*c* of the X-axis direction expandable actuator 48, so as to be able to move on the movable plate 44 in the X-axis direction, together with the Z-axis direction expandable actuator 46 and the Y-axis direction expandable actuator 47. A housing 48*d* of the X-axis direction expandable actuator 48 extends in the X-axis direction and is attached to a bridging member 10*b*.

As illustrated in FIG. 2A and FIG. 4, the bridging member 10*b* is fixed to the base 10*a* in such a manner as to straddle the chuck 13. The clamp moving mechanism 45, formed by the respective expandable actuators 46-48, is provided above the chuck 13 in the Z-axis direction via the bridging member 10*b*. Control signals of the controller 15 for controlling servomotors 46*a* to 48*a* are inputted to the respective servomotors 46*a*-48*a* of the respective expandable actuators 46-48.

Figure 9:
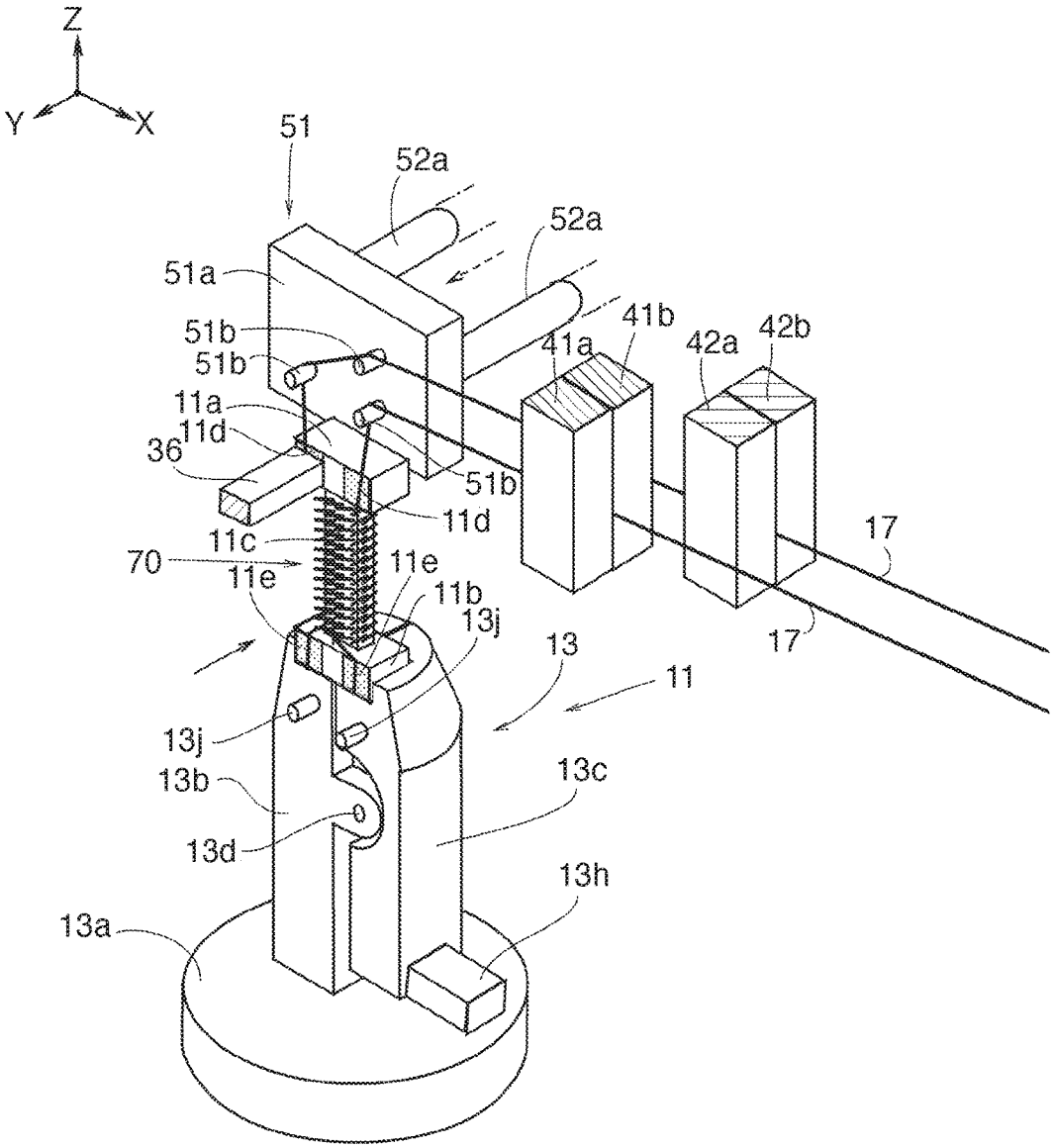
FIG. 9 is a perspective view illustrating a state where the wires, at the end of winding, are fixed to terminals on the other side of the core.

The clamp moving mechanism 45 causes the clamp devices 41 and 42 to move together with the moving plate 22. As illustrated in FIG. 6 and FIG. 9, the clamp moving mechanism 45 grips the end portions of the plurality of wires 17, delivered from the nozzles 18, and routes the wires 17 so that the wires 17 are overlapped on the electrodes 11*d* and 11*e* of the core 11.

Further, as illustrated in FIG. 2A to FIG. 4, a locking member 51 is attached via a cylinder 52 to the base 10*a* that is covered by the bridging member 10*b*. The cylinder 52 is attached to the base 10*a* in such a manner that retractable shafts 52*a* are along the Y-axis direction facing the chuck 13. The locking member 51 is attached to the projection ends of the retractable shafts 52*a*. The locking member 51 is formed of a plate member 51*a* that is attached to the retractable shafts 52*a*, and a plurality of upper locking pins 513 that are projected from the plate member 51*a*.

As illustrated in FIG. 6 and FIG. 9, while the retractable shafts 52*a* are projected, the plate member 51*a* is made to contact the flange portion 11*a* of the core 11, whose flange portion 11*b* is gripped by the chuck 13, from the Y-axis direction. In this state, the wires 17 are looped around the plurality of upper locking pins 51*b*, projecting from the plate member 51*a* so that the wires 17 are overlapped on the electrodes 11*d* and 11*e* of the core 11 that is held by the chuck 13.

Next, referring to FIGS. 1 and 10-14, the wire delivering mechanism 60 of the winding device 9 will be explained.

As illustrated in FIG. 1, the wire delivering mechanism 60 is provided with a disc 62 as a spool supporting mechanism that supports the plurality of spools 61 in substantially parallel with each other, and a servo motor 63 as a spool rotation driving mechanism that causes the disc 62 to rotate about the rotation axis being substantially parallel with the axes of the plurality of spools 61 and being coaxial with or substantially parallel with the rotation axis of the shaft 19.

The central axis of the disc 62 is in the Y-axis direction. The disc 62 is driven to rotate by the relatively large servomotor 63 whose rotating shaft 63*a* is in the Y-axis direction. The disc 62 is coaxially attached to the rotating shaft 63*a* of the servomotor 63. The servomotor 63 is fixed to a movable base 60*a* in such a manner that the rotating shaft 63*a* faces the wire winding mechanism 10 (in the Y-axis direction in FIG. 1).

Figure 10:
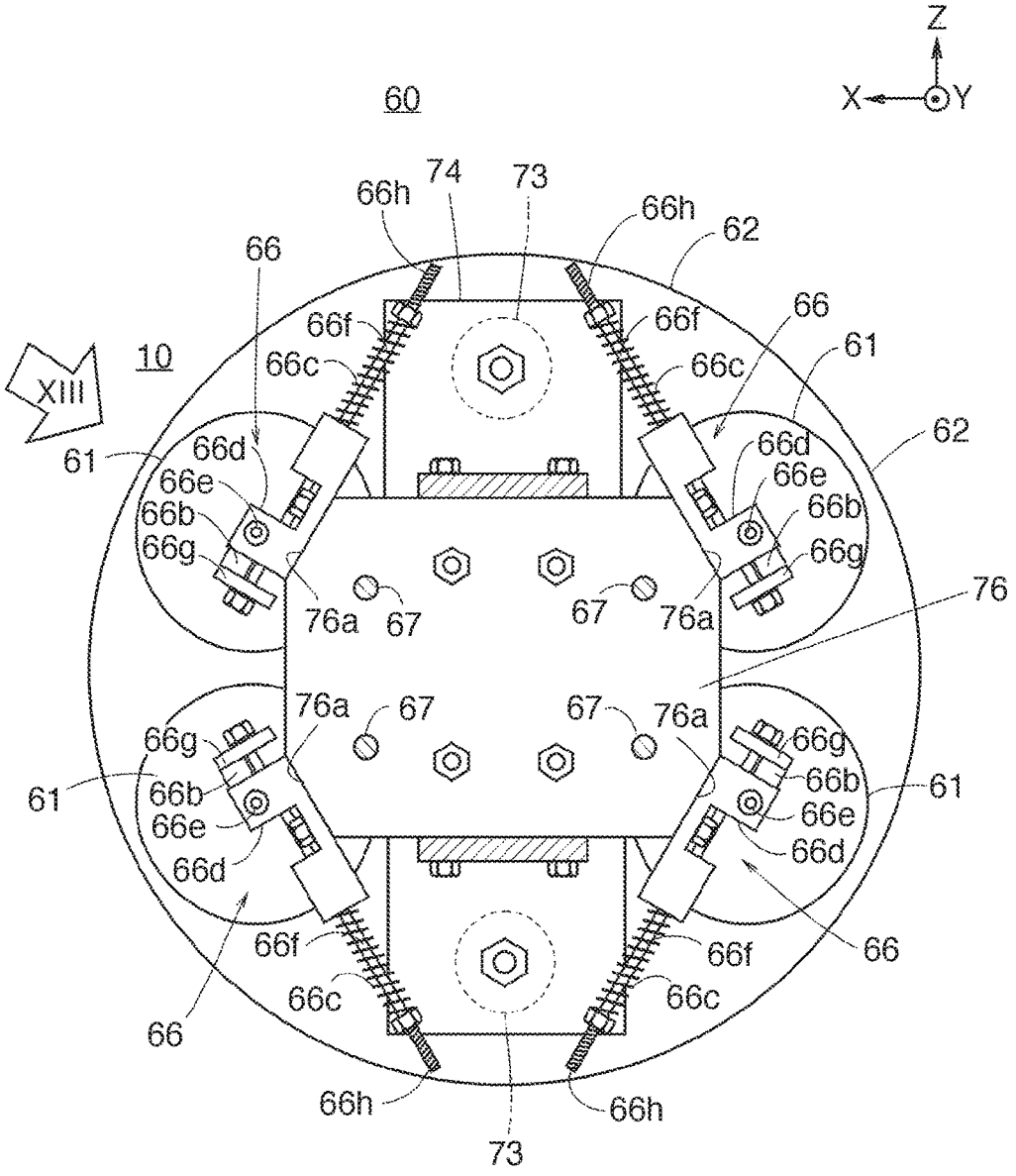
FIG. 10 is a cross sectional view taken along X-X line in FIG. 1.
Figure 11:
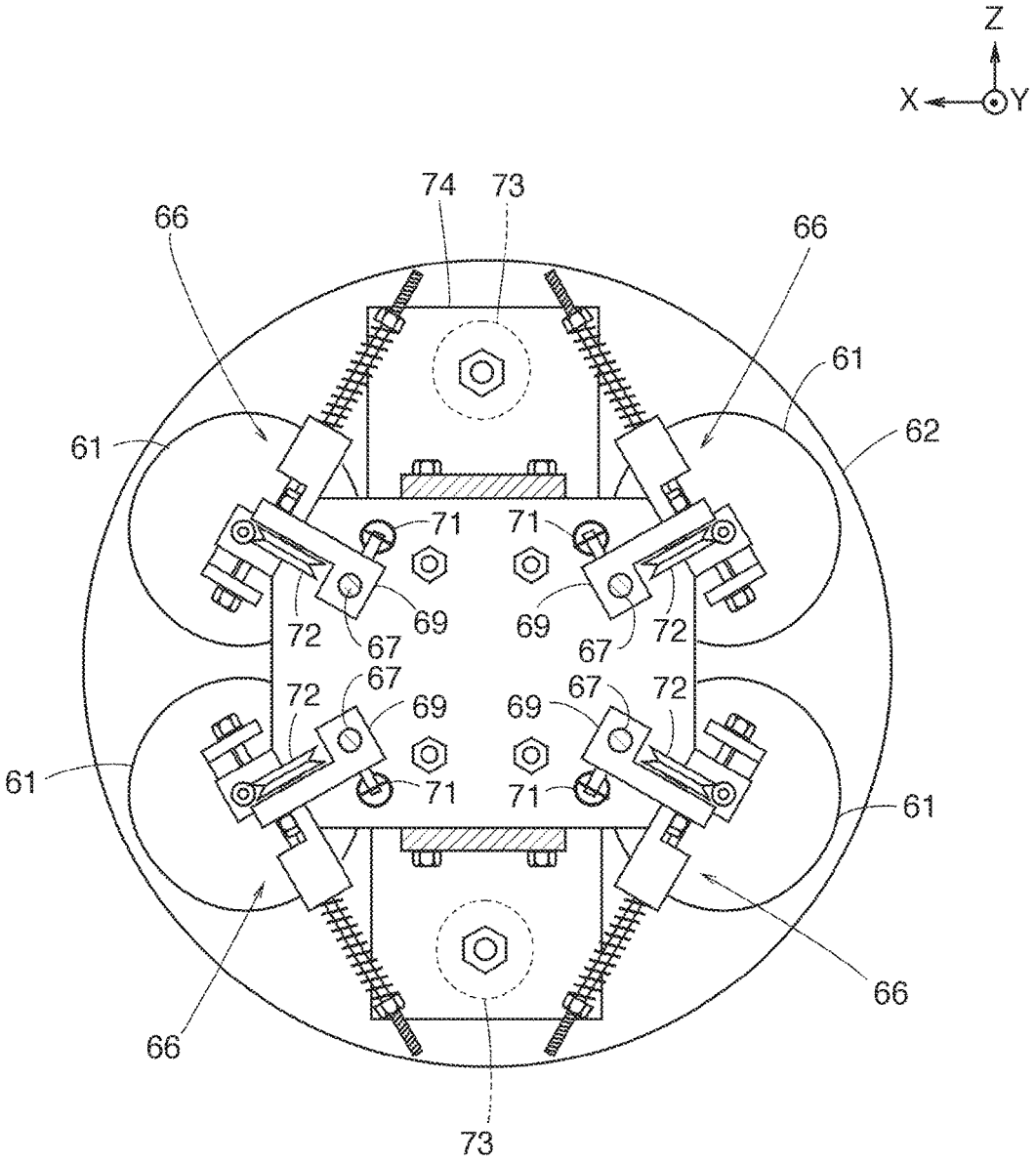
FIG. 11 is a cross sectional view taken along XI-XI line in FIG. 1.
Figure 12:
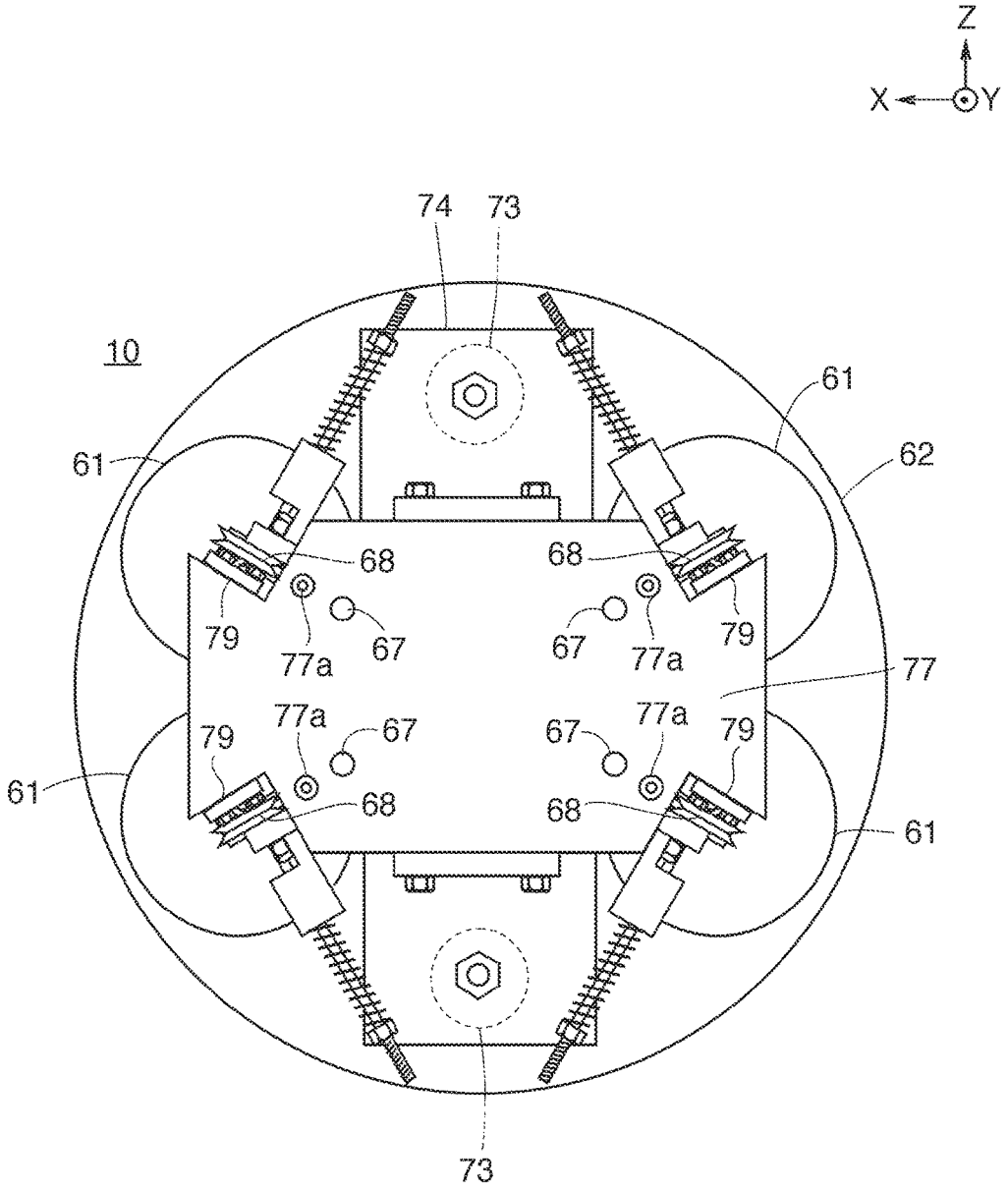
FIG. 12 is a cross sectional view taken along XII-XII line in FIG. 1.

The number of spools 61 for storing the wires 17 is the same as or greater than the number of nozzles 18 of the wire winding mechanism 10 as described above. According to this embodiment, as illustrated in FIG. 10, four spools 61 are attached to the disc 62. The spools 61 are screwed to the disc 62 in such a manner that central axes thereof are in the Y-axis direction. As the two wires 17 are used in this embodiment, the wires 17 are wound around the two spools 61, out of the four spools 61 attached to the disc 62, for storage.

Referring to FIG. 1, a control signal from the controller 15 is inputted to the servomotor 63. The controller 15 causes the disc 62 to rotate in synchronism with the rotation of the shaft 19.

The disc 62 is rotated by rotating the rotating shaft 63*a*, provided on the servomotor 63 in the Y-axis direction. The disc 62 rotates about the rotation axis being substantially parallel with the axes of the plurality of spools 61 and being coaxial with or substantially parallel with the rotation axis of the shaft 19.

On the disc 62, a plurality of tension applying mechanisms 64 that separately apply predetermined tension to the plurality of wires 17, unwound separately from the plurality of spools 61, are provided.

All the tension-applying mechanisms 64 are identical to each other in this embodiment, and one of these will be explained as an example.

Figure 13:
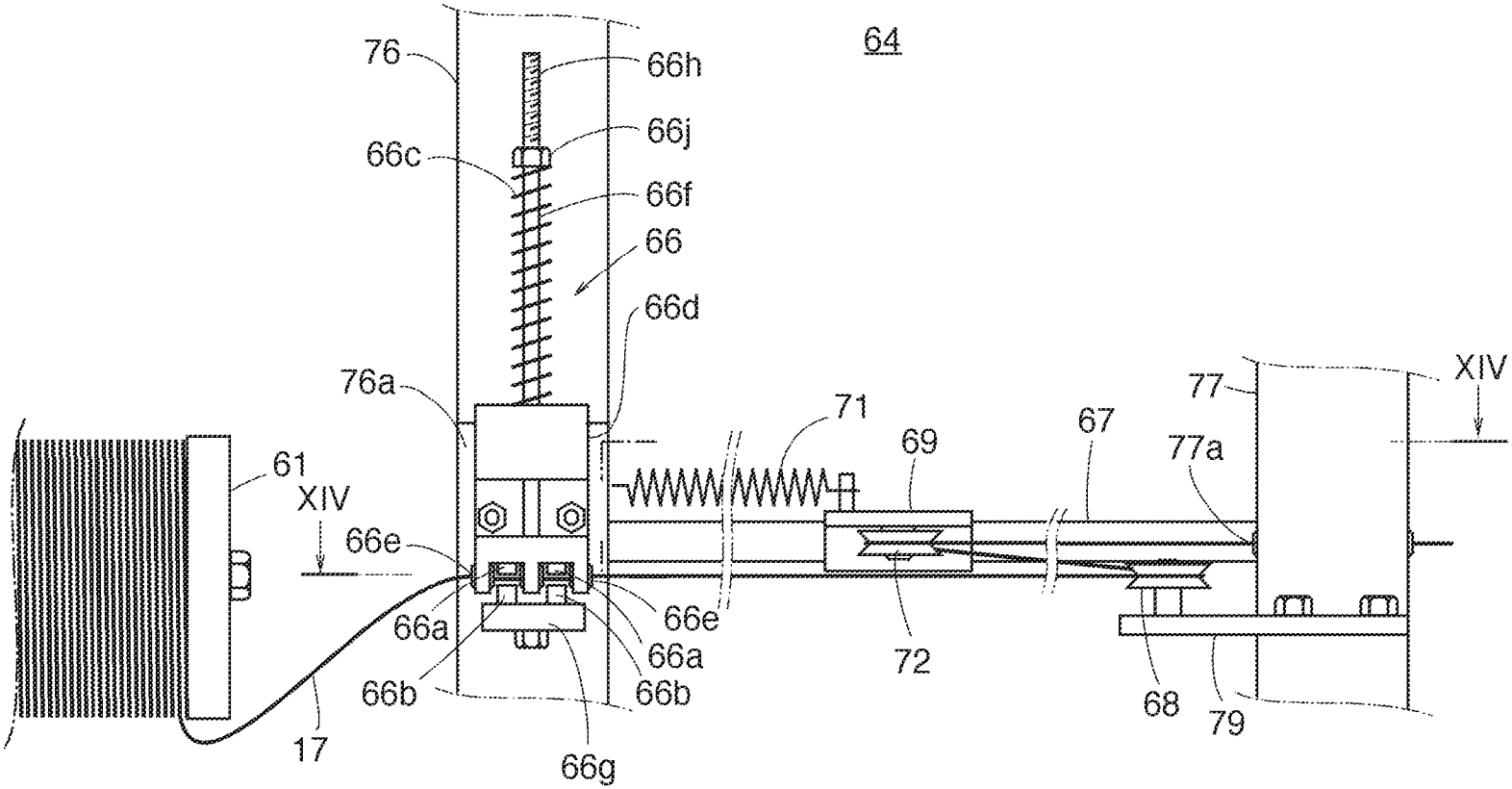
FIG. 13 is a view illustrating a tension applying mechanism viewed from XIII direction in FIG. 10.
Figure 14:
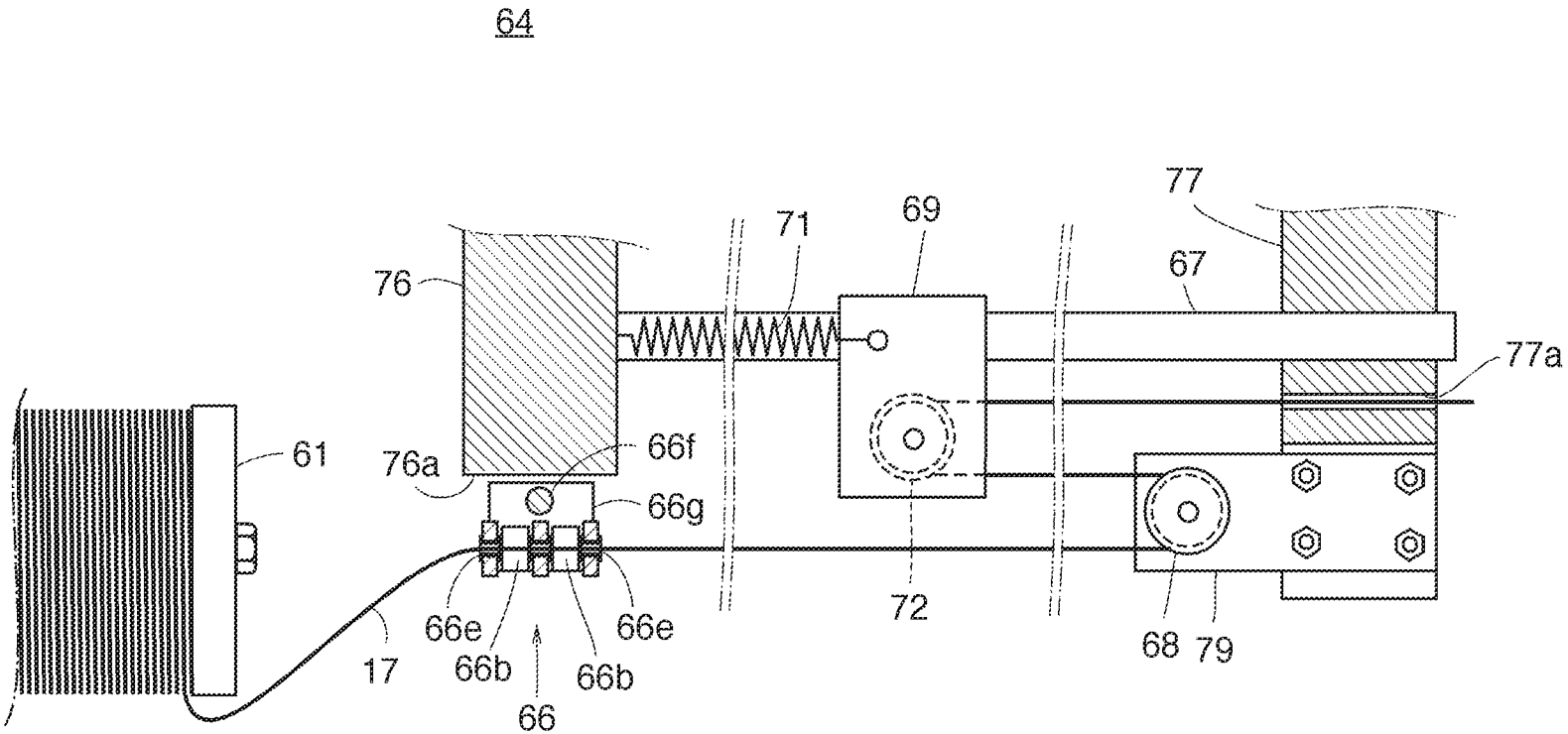
FIG. 14 is a cross sectional view taken along XIV-XIV line in FIG. 13.

As illustrated in FIG. 13 and FIG. 14, the tension applying mechanism 64 is provided with a gripping mechanism 66 that grips the wire 17 unwound from the spool 61 while allowing the wire 17 to move, a shaft 67 that is provided to extend from the gripping mechanism 66 toward the direction of the nozzle 18, a first return pulley 68 that is supported so as to be free to rotate at a tip end of the shaft 67, a slider 69 that is provided to be able to move relative to the shaft 67, a coil spring 71 as a biasing unit that biases the slider 69 toward the direction away from the first return pulley 68, and a second return pulley 72 that is supported by the slider 69 so as to be free to rotate. The wire 17 that passes through the gripping mechanism 66 and is returned by the first return pulley 68 to head toward the gripping mechanism 66, is returned again by the second return pulley 72 so as to head toward the nozzle 18.

As illustrated in FIG. 1, a vertical plate 74 is attached to the disc 62 via columns 73 provided along the Y-axis direction. A square plate 76 is attached to the vertical plate 74 coaxially with the disc 62.

As illustrated in FIG. 10, notches 76*a* are formed at four corners of the square plate 76. The gripping mechanism 66 that movably grips the wire 17 unwound from the spool 61 is provided at each notch 76*a*.

As illustrated in FIG. 13, the gripping mechanism 66 according to this embodiment is provided with a fixed sliding member 66*a* that faces the wire 17 unwound from the spool 61, a movable sliding member 66*b* that is provided to move in a rotating direction of the disc 62 and sandwich the wire 17 between itself and the fixed sliding member 66*a*, and a coil spring 66*c* configured to extend in the rotating direction of the disc 62 to bias the movable sliding member 66*b* to be pushed against the fixed sliding member 66*a*.

The fixed sliding member 66*a* is formed of a material such as sapphire, the material having high wear resistance and heat resistance. The fixed sliding member 66*a* is adhered to an attaching tool 66*d* that is screwed to the notch 76*a* of the square plate 76. In the attaching tool 66*d*, guide holes 66*e* that guide the wire 17 unwound from the spool 61 to go along the fixed sliding member 66*a* in the Y-axis direction are formed in positions corresponding to both sides of the fixed sliding member 66*a* in the Y-axis direction.

A relatively long movable pin 66*f* that is provided along the rotating direction of the square plate 76, rotating with the disc 62, penetrates the attaching tool 66*d*. An attaching base 66*g* is attached to one end portion of the movable pin 66*f*, projecting from the attaching tool 66*d* to a side of the fixed sliding member 66*a*. The movable sliding member 66*b* is adhered to the attaching base 66*g* so as to face against the fixed sliding member 66*a* to sandwich the wire 17 therebetween.

Similarly to the fixed sliding member 66*a*, the movable sliding member 66*b* is formed of a material such as sapphire, the material having high wear resistance and heat resistance. When the movable pin 66*f*, together with the attaching base 66*g*, moves in the rotating direction of the square plate 76, and the movable sliding member 66*b* approaches the fixed sliding member 66*a*, the movable sliding member 66*b* sandwiches the wire 17 together with the fixed sliding member 66*a*.

Meanwhile, the coil spring 66*c* is fitted into the other end side of the movable pin 66*f* penetrating the attaching tool 66*d*. A male screw 66*h* is formed at another end portion of the movable pin 66*f*. A female screw nut 66*j* is screwed to the male screw 66*h*. The female screw nut 66*j* compresses the coil spring 66*c* between itself and the attaching tool 66*d*. The coil spring 66*c* thereby biases the female screw nut 66*j* to the direction away from the attaching tool 66*d*. The coil spring 66*c* pulls the movable pin 66*f*, to which the female screw nut 66*j* is screwed, to a side of the another end portion and biases the movable sliding member 66*b* to be pushed against the fixed sliding member 66*a*.

When the wire 17 is gripped by the movable sliding member 66*b* and the fixed sliding member 66*a*, a force to move the wire 17 in the longitudinal direction, by gripping pressure, is required. The force to make sliding movement of the wire 17 in the longitudinal direction is proportional to the biasing force that presses the movable sliding member 66*b* against the fixed sliding member 66*a*. Therefore, the tension applying mechanism 64 can adjust a delivering force of the wire 17 by adjusting a screwing amount of the female screw nut 66*j* and changing a compressing amount of the coil spring 66*c*.

The coil spring 66*c* is provided along the direction of the rotation axis of the disc 62. Therefore, even when the disc 62 rotates and a centrifugal force is generated, the centrifugal force is generated in the radial direction of the disc 62, which does not influence the biasing force of the coil spring 66*c* that is provided along the direction of the rotation. Thus, the biasing force that pushes the movable sliding member 66*b* against the fixed sliding member 66*a* does not change even when the disc 62 is rotated. Accordingly, the adjusted delivering force of the wire 17 does not change by the rotation of the disc 62.

The tension applying mechanism 64 has the shaft 67 that is provided from the vicinity of the gripping mechanism 66 along the direction of the nozzle 18 (Y-axis direction). A base end of the shaft 67 is attached to the square plate 76 near the gripping mechanism 66. The shaft 67 extends from the square plate 76 in the Y-axis direction. To a tip end of the shaft 67, an end plate 77 that is parallel with the square plate 76 is attached coaxially with the square plate 76.

As illustrated in FIG. 1, a pair of holding plates 78, in addition to the shafts 67, is attached to the square plate 76 and the end plate 77 on the outside of the shafts 67. This makes it possible to prevent a bend of the shaft 67 that is provided along the Y-axis direction.

As illustrated in FIG. 13 and FIG. 14, the first return pulley 68 that returns the wire 17 passed through the gripping mechanism 66 is supported so as to be free to rotate by the end plate 77 provided at the tip end of the shaft 67. The first return pulley 68 is attached to the end plate 77 via a pivotally supporting plate 79. The first return pulley 68 is supported so as to be free to rotate by the pivotally supporting plate 79 that is attached at a corner of the end plate 77.

To the shaft 67 between the square plate 76 and the end plate 77, the slider 69 is provided to be able to make reciprocating movement there-between. The second return pulley 72 is supported by the slider 69 so as to be free to rotate. The wire 17 that passes through the gripping mechanism 66 and is returned by the first return pulley 68 to head toward the gripping mechanism 66, is returned again by the second return pulley 72 so as to head toward the nozzle 18.

The coil spring 71 is bridged between the slider 69 and the square plate 76. The coil spring 71 pulls the slider 69 toward the direction of the square plate 76 so as to bias the second return pulley 72, supported by the slider 69 so as to be free to rotate, toward the direction away from the first return pulley 68.

A through hole 77*a* is formed in the end plate 77 facing the nozzle 18 such that the wire 17 returned by the second return pulley 72 and heading toward the nozzle 18 passes through. In order to bias the second return pulley 72, any biasing means having a biasing function may be employed instead of the coil spring 71.

With the tension applying mechanism 64, a force of the coil spring 71 pulling the slider 69 toward the direction of the square plate 76 is transferred to the wire 17, and the predetermined tension is generated in the wire 17. This tension is proportional to an extension amount of the coil spring 71, which is an extension length of the coil spring 71 from its free length. The extension amount of the coil spring 71 is proportional to a force of the gripping mechanism 66 exerted on the wire 17 to cause sliding movement thereof in the longitudinal direction.

Therefore, in the tension applying mechanism 64, it is possible to adjust the tension of the wire 17 by adjusting the screwing amount of the female screw nut 66*j*.

As illustrated in FIG. 1, rollers 10*c* and 60*c* and fixing legs 10*d* and 60*d* are provided on the base 10*a* of the wire winding mechanism 10 and the movable base 60*a* of the wire delivering mechanism 60, respectively. The fixing legs 10*d* and 60*d* are provided to be able to extend/contract in the vertical direction (Z-axis direction). When the fixing legs 10*d* and 60*d* are contracted, the rollers 10*c* and 60*c* are grounded, and the wire winding mechanism 10 and the wire delivering mechanism 60 are able to move by rotating the rollers 10*c* and 60*c*. When the fixing legs 10*d* and 60*d* are extended to desired vertical positions, the wire winding mechanism 10 and the wire delivering mechanism 60 can be grounded.

According to this embodiment, explanations have been made assuming that the base 10*a* and the movable base 60*a* are independent from each other, but it is also possible to construct the base 10*a* and the movable base 60*a* in one piece. Further, arrangement of the devices and the mechanisms in the X-axis, Y-axis, and Z-axis direction may be changed within the scope of the present invention.

Next, a winding method using the winding device 9 will be explained.

According to the winding method of this embodiment, the plurality of wires 17, each passed through and delivered from the plurality of nozzles 18, are twisted and wound around the outer periphery of the core 11. According to this winding method, the plurality of wires 17, unwound separately from the plurality of spools 61 that are held in substantially parallel with each other, separately pass through the plurality of nozzles 18 that are held in substantially parallel with each other. Then, the plurality of nozzles 18 are rotated about the rotating shaft 63*a* that is substantially parallel to the plurality of nozzles 18.

This embodiment is characterized in that the plurality of spools 61 are rotated in synchronism with the rotation of the plurality of nozzles 18 about the rotation axis being substantially parallel with the plurality of spools 61 and being coaxial with or substantially parallel with the rotation axis of the plurality of the nozzles 18.

The winding method to the core 11 having the electrodes 11*d* and 11*e* includes a process of welding and fixing the tip end of each of the plurality of wires 17, delivered from the plurality of nozzles 18, to the electrodes 11*e*, a process of forming a twisted portion 17*a* by rotating the plurality of nozzles 18 by the nozzle rotation driving mechanism 21 to twist the plurality of wires 17, and a process of winding the twisted portion 17*a* of the wires 17 around the outer periphery of the core 11 rotating about the axis. The controller 15 controls rotation speed of the plurality of nozzles 18 by the nozzle rotation driving mechanism 21 in relation with the rotation speed of the core 11 so as to keep the length of the twisted portion 17*a* constant.

Each of the processes will be explained in detail.

<Wire Welding Process at the Beginning of Winding>

In the wire welding process, the wires 17 that are each delivered from the plurality of nozzles 18 are respectively joined to the electrodes 11*e* formed on one side of the end portions of the core 11 that is gripped by the chuck 13.

First, as illustrated in FIG. 1, the plurality of spools 61, around which the wires 17 are stored, are prepared and the plurality of spools 61 are attached to the disc 62. Then, the wires 17, unwound from the spools 61, are caused to pass through the nozzles 18.

Specifically, as illustrated in FIG. 13 and FIG. 14, since the tension applying mechanism 64 is provided according to this embodiment, each wire 17 that is unreeled from each spool 61 is caused to pass through the gripping mechanism 66 using each of the guide holes 66*e*.

The wire 17, returned by the first return pulley 68 and further returned by the second return pulley 72, is caused to pass through the through hole 77*a* in the end plate 77. The wire 17, passed through the through hole 77*a*, is guided by the wire winding mechanism 10 to pass through the nozzle 18. The delivered ends of the wires 17 are then gripped by the clamp devices 41 and 42.

Meanwhile, as illustrated in FIG. 6, the flange portion 11*b*, on one side of the end portions of the core 11, is gripped by the chuck 13. Specifically, the flange portion 11*b* on one side of the end portions of the core 11 is received in the recessed portion 13*f* at the tip end of the chuck 13 (refer to FIG. 5), and the flange portion 11*b* is gripped by the tip ends of the swinging member 13*c* and the main gripping portion 13*b* that are biased by the coil spring 13*e* (refer to FIG. 2B). The flange portion 11*b* on one side of the end portions of the core 11 is received by the recessed portion 13*f* and gripped by the chuck 13 in this way.

Next, as illustrated in FIG. 6, the retractable shafts 52*a* of the cylinder 52 are projected and, from the Y-axis direction, the plate member 51*a* is brought into contact with the flange portion 11*a* of the core 11, whose flange portion 11*b* is gripped by the chuck 13.

The nozzles 18 and the clamp devices 41 and 42 are then moved by the nozzle moving mechanism 31 and the clamp moving mechanism 45, respectively, such that the wires 17 delivered from the tip ends of the nozzles 18 (refer to FIG. 1) and gripped by the clamp devices 41 and 42 are set in wire winding mechanism 10. Specifically, the wires 17 are looped around the lower locking pins 13*j*, pulled upward, and further looped around the upper locking pins 51*b*.

Thus, the wires 17 between the lower locking pins 13*j* and the upper locking pins 51*b* are placed on the electrodes 11*e* formed on the flange portion 11*b* on one side of the core 11. Thereafter, the electrical heating iron 36 is moved by the nozzle moving mechanism 31 and brought into contact with the wires 17 overlapped on the electrodes 11*e*. The wires 17 are thereby heated and respectively soldered to the solder layer forming the electrodes 11*e*.

After the wires 17 are soldered to the electrodes 11*e*, the retractable shafts 52*a* of the cylinder 52 are retracted, and the locking member 51 is separated from the flange portion 11*a* of the core 11. Further, the electrical heating iron 36 is detached from the electrodes 11*e* by the nozzle moving mechanism 31. Simultaneously, the clamp devices 41 and 42 are detached away from the electrodes 11*e* by the clamp moving mechanism 45 (refer to FIG. 2A), and the wires 17 that are gripped by the clamp devices 41 and 42 are torn off near the electrodes 11*e*. Thereafter, the clamp devices 41 and 42 are moved to standby positions for standby.

Thus, when winding starts, the wires 17 that are delivered from the nozzles 18 are joined to the two electrodes 11*e* on the flange portion 11*b* on one side of the end portions of the core 11.

<Twisted Portion Forming Process>

In the twisted portion forming process, the plurality of nozzles 18 is rotated by the nozzle rotation driving mechanism 21, so as to twist the plurality of wires 17. Then, the twisted portion 17*a* having the fixed length from the core 11 is formed.

Figure 7:
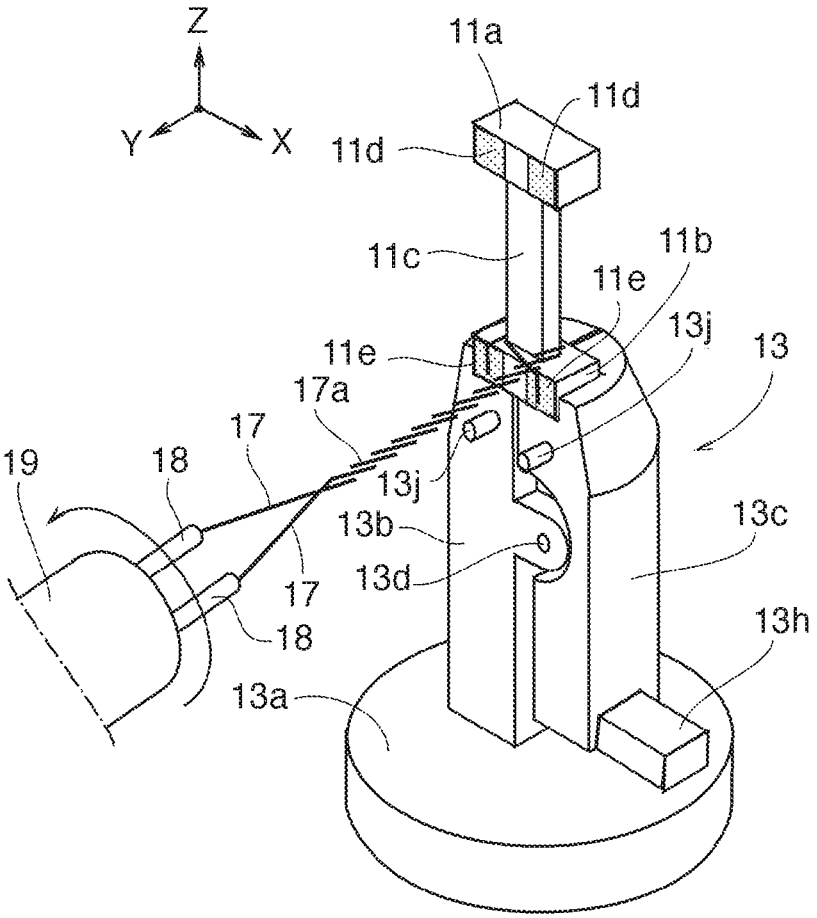
FIG. 7 is a perspective view illustrating a state where the plurality of wires, extending from the core to nozzles, is twisted.

Firstly in this process, as illustrated in FIG. 7, the chuck 13 is rotated about one or two times together with the core 11 while moving the nozzles 18. As a result, the wires 17, a part of which is joined to the electrodes 11*e* as the beginning of winding, are pulled into the winding drum portion 11*c*. The wires 17 delivered from the nozzles 18 are thereby guided to the winding drum portion 11*c* of the core 11.

After the wires 17 are pulled into the winding drum portion 11*c* from the flange portion 11*b* on one side, the nozzle rotation driving mechanism 21 (refer to FIG. 2A and FIG. 3) causes the shaft 19, on which the plurality of nozzles 18 are held, to rotate about the axis as the rotation center. The two wires 17 extending from the nozzles 18 to the core 11 are thus twisted, thereby forming the twisted portion 17*a*.

At this time, in the wire delivering mechanism 60 that delivers the wires 17, the control signal from the controller 15 illustrated in FIG. 1 causes the disc 62, on which the plurality of spools 61 are provided, to rotate together with the plurality of spools 61 by the servo motor 63, in synchronism with the rotation of the plurality of nozzles 18.

Although the plurality of wires 17, passing through the plurality of nozzles 18 separately, are delivered from the separate spools 61 around which the wires 17 are wound for storage, the wires 17 between the spools 61 and the nozzles 18 are not twisted because the plurality of spools 61 are also rotated when the plurality of the nozzles 18 are rotated at the time of twisting the wires 17. Therefore, the twisted amount of the plurality of wires 17 to be wound around the core 11 has no restrictions, and the twisted portion 17*a* having the desired length can be formed.

<Wire Winding Process>

In the wire winding process, the plurality of wires 17, respectively delivered from the plurality of rotating nozzles 18, are twisted and wound around the outer periphery of the core 11 that rotates about the axis.

In this process, the chuck motor 14 (refer to FIG. 2A) is driven, and the chuck 13, provided coaxially with the rotating shaft 14*a*, is rotated together with the core 11 that is supported by the chuck 13.

Figure 8:
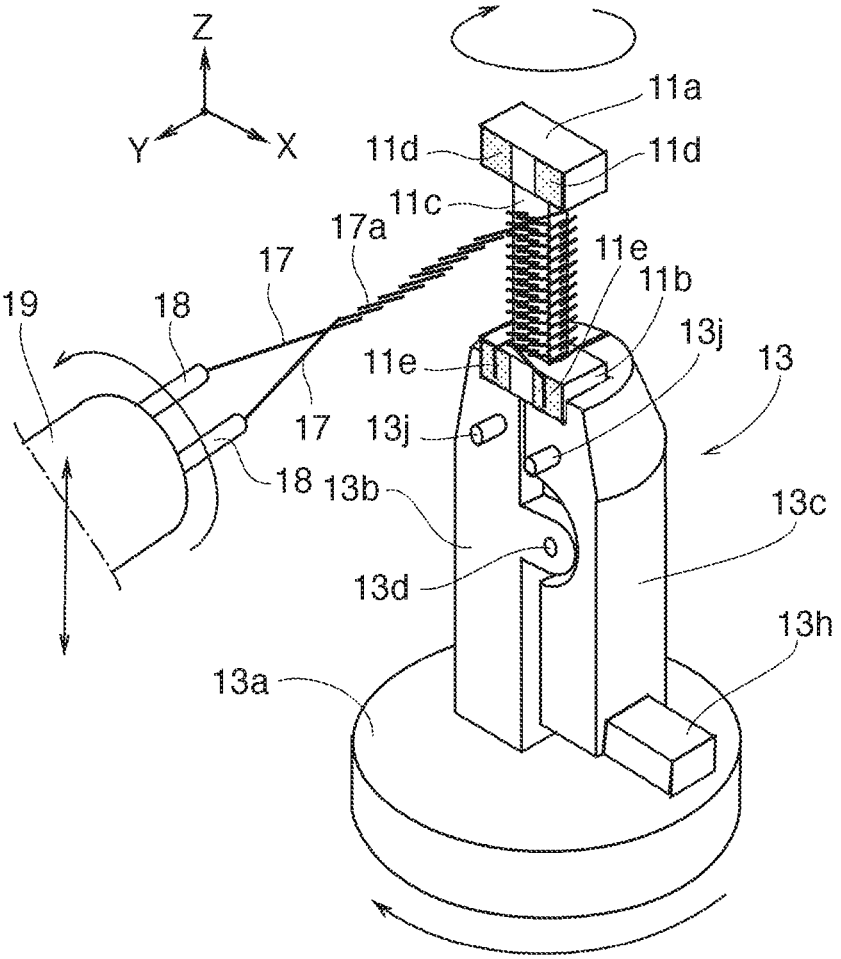
FIG. 8 is a perspective view illustrating a state where the wires, delivered from the rotated nozzles and twisted, are wound around a winding drum portion.

Meanwhile, as illustrated in FIG. 8, the plurality of nozzles 18 are rotated, causing the wires 17, newly delivered from the plurality of nozzles 18, to be twisted and wound around the winding drum portion 11*c* of the rotating core 11. At this time, as illustrated by the arrow with a solid line in FIG. 8, it is desirable to cause the nozzles 18 to make reciprocating movement in the axial direction of the core 11 by the nozzle moving mechanism 31 (refer to FIG. 2A). It is also preferable to provide a unit that is configured to define a unit movement distance in the reciprocating movement of the nozzles 18.

The wires 17 are wound for a predetermined number of times to obtain a coil 70 (refer to FIG. 9).

Also in the wire winding process, the controller 15 illustrated in FIG. 1 controls the rotation of the plurality of nozzles 18 by the nozzle rotation driving mechanism 21, so as to keep the length of the twisted portion 17*a* constant, in response to the rotation speed of the core 11.

The twisted portion 17*a* is formed in the twisted portion forming process by twisting the plurality of wires 17 with a predetermined degree of twisting. In the wire winding process also, the controller 15 controls the rotation of the plurality of nozzles 18 by the nozzle rotation driving mechanism 21. Thus, every time the twisted portion 17*a* is wound around the winding drum portion 11*c* by a predetermined length, the plurality of nozzles 18 are rotated for corresponding times, thereby forming the twisted portions 17*a* with a constant degree of twisting.

When the wires 17 that have been delivered from the nozzles 18 and twisted are wound around the core 11 so as to increase a wire density of a coil, it is necessary to twist the plurality of wires 17 in a regulated manner with a predetermined degree of twisting. For example, such a twist in which one of the wires 17 extends straight and another wire 17 goes therearound is not desirable. For this reason, when the delivered wires 17 are twisted by rotating the plurality of nozzles 18, it is necessary to cause tension of the wires 17 delivered from the respective nozzles 18 to be substantially equal to each other and to suppress fluctuation in the tension as much as possible.

According to this embodiment, the predetermined tension is applied to the plurality of wires 17, unwound separately from the plurality of spools 61, by the plurality of tension applying mechanisms 64 that are provided separately. Therefore, the tension of the wires 17 that are delivered from the respective nozzles 18 is made to be substantially equal to each other and the fluctuation in the tension of the wires 17 that are delivered from the nozzles 18 can be suppressed. Thus, it is possible to wind the twisted wires 17 around the core 11 in a state where they are twisted in a regulated manner with the predetermined degree of twisting.

Also in the wire winding process, the control signal from the controller 15 causes the servo motor 63 to rotate the disc 62, on which the plurality of spools 61 are provided, in synchronism with the rotation of the plurality of nozzles 18 in the wire delivering mechanism 60 that delivers the wires 17. This makes it possible to prevent twisting of the wires 17 between the spools 61 and the nozzles 18.

The formation of the twisted portion 17*a* by rotating the nozzles 18 is made to such length that the entire twisted portion 17*a* is wound around the winding drum portion 11*c*. When the entire twisted portion 17*a* is wound around the winding drum portion 11*c*, and the coil 70 formed by the wires 17 that are wound by the necessary and predetermined number of times (refer to FIG. 9) is obtained, the rotation of the core 11 is stopped and the wire winding process is ended.

<Wire Welding Process at the End of Winding>

In the wire welding process at the end of winding, the wires 17 that are delivered from the nozzles 18 are joined to the flange portion 11*a* on another side of the core 11, whose end portion on one side is gripped by the chuck 13.

Firstly in this process, the retractable shafts 52*a* of the cylinder 52 are projected and, from the Y-axis direction, the plate member 51*a* is brought into contact again with the flange portion 11*a* of the core 11, whose flange portion 11*b* is gripped by the chuck 13.

The nozzles 18 are then moved by the nozzle moving mechanism 31 (refer to FIG. 2A) and, as illustrated in FIG. 9, the wires 17 that are delivered from the tip ends of the nozzles 18 and are wound around the winding drum portion 11*c* are pulled out from the winding drum portion 11*c* and are hooked on the upper locking pins 51*b*, respectively.

Thus, the wires 17 that continue from the coil 70 and are at the end of the winding are placed on the electrodes 11*d* that are formed on the flange portion 11*a* on the another side of the core 11.

Next, the clamp devices 41 and 42 are moved by the clamp moving mechanism 45 (refer to FIG. 2A) and, as illustrated in FIG. 9, the wires 17 that are delivered from the tip ends of the nozzles 18 and are looped around the upper locking pins 51*b* are gripped by the clamp devices 41 and 42 between the nozzles 18 and the upper locking pins 51*b*.

Thereafter, the electrical heating iron 36 is moved by the nozzle moving mechanism 31 (refer to FIG. 1) and brought into contact with the wires 17 overlapped on the electrodes 11*d*. Thereby, it is possible to heat the wires 17, and solder the wires 17 to the solder layer forming the electrodes 11*d*. At this time, the flange portion 11*a*, on which the electrodes 11*d* are formed, is supported by the plate member 51*a* that makes contact therewith from the opposite side. Thus, the electrical heating iron 36 can be surely brought into contact with the wires 17 overlapped on the electrodes 11*d*.

After the wires 17 are soldered to the electrodes 11*d*, the electrical heating iron 36 is detached from the electrodes 11*d* by the nozzle moving mechanism 31 (refer to FIG. 1). Simultaneously, the clamp devices 41 and 42 are detached from the electrodes 11*d* by the clamp moving mechanism 45 (refer to FIG. 2A), and the wires 17 that are gripped by the clamp devices 41 and 42 are torn off near the electrodes 11*d*.

Thus, the wires 17 that continue from the coil 70 and are at the end of the winding are joined to the electrodes 11*d* on the flange portion 11*a* on the another side of the core 11. Thereby, the wires 17 at the beginning of the winding and the wires 17 at the end of the winding can be separately pulled out from both sides of the core 11 and joined to the terminals 11*a*, 11*b*.

Finally, the retractable shafts 52*a* of the cylinder 52 are retracted, the locking member 51 is separated from the flange portion 11*a* of the core 11, and the core 11, around which the coil 70 is formed, is removed from the chuck 13 together with the coil 70. The processes of the winding method are thereby terminated.

After the wires 17 are torn off, the clamp devices 41 and 42 move to the standby positions for standby while gripping the wires 17 delivered from the nozzles 18. In this way, a shift to the winding process to the next core 11 is performed promptly.

According to the winding device 9 and the winding method of this embodiment as explained above, the plurality of spools 61 are rotated in synchronism with the rotation of the plurality of nozzles 18. Although the plurality of wires 17 passing through the plurality of nozzles 18 separately are provided from the separate spools 61 for storage, the wires 17 between the spools 61 and the nozzles 18 are not twisted, since the plurality of spools 61 are also rotated when the plurality of the nozzles 18 are rotated to twist the wires 17. Therefore, there is no restriction in the twisted amount of the plurality of wires 17 that are wound around the core 11.

In addition, it is not necessary to eliminate the twist of the wires 17 between the spools 61 and the nozzles 18 by rotating the plurality of nozzles 18 in the reverse direction, after the twisted wires 17 are wound around the core 11. Continuous winding is made possible as the next winding can be done without performing untwisting.

The predetermined tension is applied to the plurality of wires 17 separately unwound from the plurality of spools 61, by the plurality of tension applying mechanisms 64 that are provided separately. Therefore, the tension of the wires 17 that are delivered from the respective nozzles 18 is made to be substantially equal to each other, and the fluctuation in the tension of the wires 17 that are delivered from the nozzles 18 can be suppressed. Thus, the wires 17 that are twisted in a regulated manner with the predetermined degree of twisting can be wound around the core 11.

It should be noted that, according to the above-described embodiment, an explanation was given using the core 11 whose winding drum portion 11*c* has a square cross section. However, the cross section of the winding drum portion 11*c* of the core 11 is not limited to a square shape, and one having a circular cross section, for example, may be employed.

Further, according to the above-described embodiment, an explanation was made of a case where the joining means is soldering using the electrical heating iron 36. However, the joining means may be such means as to electrically join the wires 17 to the electrodes 11*d* and 11*e* by thermocompression, for example.

According to the above-described embodiment, the wires 17 are soldered to the electrodes as the terminals, but the wires may be fixed to the terminals by tying or fusing.

According to the above-described embodiment, the nozzle rotation driving mechanism 21 provided with the rotary motor 24 has been explained as an example. However, the nozzle rotation driving mechanism 21 is not limited to an electric motor as long as it can rotate the plurality of nozzles 18. For example, a fluid pressure motor capable of rotating the plurality of nozzles 18 by fluid pressure of compressed air or the like may be used instead of the electric motor.

Further, according to the above-described embodiment, an explanation was made of the case where two wires 17 are twisted and wound around the core 11. However, the number of the wires 17 is not limited to two. To summarize, the nozzles 18, whose number is the same as the number of wires 17 to be twisted should be held by the shaft 19 and rotated simultaneously by the nozzle rotation driving mechanism 21. With this construction, the number of the wires 17 may be three, four, five, or six or more.

The following effects can be obtained by the above-described embodiment.

According to the winding device 9 and the winding method of this embodiment, the plurality of spools 61 are rotated in synchronism with the rotation of the plurality of nozzles 18. Although the plurality of wires 17 passing through the plurality of nozzles 18 separately are delivered from the separate spools 61 for storage, the plurality of spools 61 are also rotated when the plurality of the nozzles 18 are rotated for twisting the wires 17. Accordingly, the wires 17 between the spools 61 and the nozzles 18 are not twisted. As a result, there is no restriction in the twisted amount of the plurality of wires 17 that are wound around the core 11.

In addition, it is not necessary to eliminate twisting of the wires 17 between the spools 61 and the nozzles 18 by rotating the plurality of nozzles 18 in the reverse direction, after the twisted wires 17 are wound around the core 11. Since the next winding can be done without performing untwisting, continuous winding is made possible.

The plurality of tension applying mechanisms 64 are provided for applying the predetermined tension separately to the plurality of wires 17, which are separately unwound from the plurality of spools 61. As a result, the tension of the wires 17 that are delivered from the respective nozzles 18 is made to be substantially equal to each other, and the fluctuation in the tension can be suppressed. Accordingly, the wires 17 that are twisted in a regulated manner with a predetermined degree of twisting can be wound around the core 11.

The contents of Tokugan 2014-041218, with a filing date of Mar. 4, 2014 in Japan, are hereby incorporated by reference.

Although the invention has been described above with reference to certain embodiments, the invention is not limited to the embodiments described above. Modifications and variations of the embodiments described above will occur to those skilled in the art, within the scope of the claims.

The embodiments of this invention in which an exclusive property or privilege is claimed are defined as follows:

The invention claimed is:

1. A winding device having a plurality of nozzles for separately delivering a plurality of wires unwound separately from a plurality of spools, and twisting and winding the plurality of wires, delivered respectively from the plurality of nozzles, around an outer periphery of a core, the winding device comprising:

a nozzle holding mechanism for holding the plurality of nozzles in a substantially parallel manner;

a nozzle rotation driving mechanism for rotating the nozzle holding mechanism about a rotation axis being substantially parallel with the plurality of nozzles;

a spool supporting mechanism for supporting the plurality of spools in a substantially parallel manner;

a spool rotation driving mechanism for rotating the spool supporting mechanism about a rotation axis being substantially parallel with the plurality of spools and being coaxially with or substantially parallel with the rotation axis of the nozzle holding mechanism; and a control unit for controlling the spool rotation driving mechanism in such a manner as to rotate the spool supporting mechanism in synchronism with rotation of the nozzle holding mechanism.

2. The winding device according to claim 1, wherein the spool supporting mechanism comprises a plurality of tension applying mechanisms for applying predetermined tension separately to the plurality of wires unwound separately from the plurality of spools.

3. The winding device according to claim 2, wherein each of the plurality of tension applying mechanisms comprises:

a gripping mechanism for movably gripping the wire unwound from the spool;

a shaft provided to extend from the gripping mechanism to a direction of the nozzle;

a first return pulley supported at a tip end of the shaft;

a slider that can move relative to the shaft;

a biasing unit for biasing the slider to a direction away from the first return pulley; and a second return pulley supported by the slider, for returning the wire rod to head toward the nozzle again, to cause the wire passed though the gripping mechanism and b returned by the first return pulley to head toward the gripping mechanism.

4. The winding device according to claim 3, wherein the gripping mechanism comprises:

a fixed sliding member provided along the wire rod unwound from the spool, a movable sliding member that can move toward a rotation direction of the spool supporting mechanism, so as to sandwich the wire rod together with the fixed sliding member, and a coil spring provided along the rotation direction of the spool supporting mechanism, so as to bias the movable sliding member to be pushed against the fixed sliding member.

5. A winding method using the winding device according to claim 1 to wind the plurality of wires around the core having terminals, comprising:

fixing tip ends of the plurality of wires, delivered from the plurality of nozzles, to the terminals;

forming a twisted portion having a fixed length from the core by rotating the plurality of nozzles by the nozzle rotation driving mechanism to twist the plurality of wires; and winding the twisted portion formed by twisting the plurality of wires delivered respectively from the plurality of rotating nozzles, around an outer periphery of the core rotating about an axis, wherein the method further comprises controlling rotation of the plurality of nozzles by the nozzle rotation driving mechanism so as to keep a constant length of the twisted portion according to a rotation speed of the core.

6. A winding method for twisting and winding a plurality of wires around an outer periphery of a core, the plurality of wires being unwound separately from a plurality of spools held in a substantially parallel manner and delivered respectively through a plurality of nozzles, the method comprising:

rotating the plurality of nozzles about a rotation axis being substantially parallel with the plurality of nozzles; and rotating the plurality of spools about a rotation axis being substantially parallel with the plurality of spools and being coaxially with or substantially parallel with the rotation axes of the plurality of nozzles, in synchronism with rotation of the plurality of nozzles.

* * * * *